US007690922B2

(12) United States Patent
Huang

(10) Patent No.: US 7,690,922 B2
(45) Date of Patent: Apr. 6, 2010

(54) ELECTRICAL CONNECTOR

(76) Inventor: Chung-Chuan Huang, No. 31, Lane 57, Jhengnan 1st St., Yongkang City, Tainan County 710 (TW)

( * ) Notice: Subject to any disclaimer, the term of this patent is extended or adjusted under 35 U.S.C. 154(b) by 43 days.

(21) Appl. No.: 12/230,719

(22) Filed: Sep. 4, 2008

(65) Prior Publication Data

US 2010/0055942 A1 Mar. 4, 2010

(51) Int. Cl.
*H01R 12/00* (2006.01)

(52) U.S. Cl. ..... 439/63

(58) Field of Classification Search ..... 439/63, 439/78, 578–581, 79, 82, 81, 55, 92
See application file for complete search history.

(56) References Cited

U.S. PATENT DOCUMENTS 4,598,961 A * 7/1986 Cohen ..... 439/63
4,741,703 A * 5/1988 Johnescu et al. ..... 439/63
4,795,533 A * 1/1989 Young et al. ..... 205/783
5,011,415 A * 4/1991 Suzuki et al. ..... 439/63
5,112,249 A * 5/1992 Henry et al. ..... 439/581
5,334,050 A * 8/1994 Andrews ..... 439/579
5,478,258 A * 12/1995 Wang ..... 439/581
5,532,659 A * 7/1996 Dodart ..... 333/260
6,053,743 A * 4/2000 Mitchell et al. ..... 439/63
6,106,304 A * 8/2000 Huang ..... 439/63
6,682,354 B2 * 1/2004 Carson et al. ..... 439/63

* cited by examiner

*Primary Examiner*—Alexander Gilman
(74) *Attorney, Agent, or Firm*—Rosenberg, Klein & Lee

(57) ABSTRACT

The present invention is to present an electrical connector of a connector assembly having a detachable flexible C-shaped clip and a visor-like ferruled docking cantilever with a lower semicircular cutout and an arched groove configured in front end thereof, wherein said flexible C-shaped clip, which is to be lodged in the arched groove, has a pair of jutted noses for being latched and gripped by a corresponding pair of dents at the docking cantilever and a pair of bent latching toes for running through a pair of corresponding bores on the PCB in securely stable manner.

3 Claims, 9 Drawing Sheets

B-B

ELECTRICAL CONNECTOR

FIELD OF THE INVENTION

The present invention relates to an electrical connector, particularly for one having feature and effect for being continuously firm and secure contact with PCB without unstable and shake condition or dropping off incident therebetween.

BACKGROUND OF THE INVENTION

Generally, the connection method for the electrical connector and PCB is accomplished by tin soldering on the contacting spot of each other for securely connecting after directly inserting the electrical connector 1 into the contacting conductor of the PCB to combine each other. The inventor of the present invention has devoted to the production and R&D of the electrical connector 1 business for many years. Having realized the harmful influence due to bad design in structure of the electrical connector, the inventor exerted concentrative effort in the addressed issue and worked out a new innovative design of electrical connector for having been granted a patent from Taiwan with patent certificate No. 215421, whose structure is shown in the FIG. 1. The basic structure for shown electrical connector 1 is a connector assembly 10 having a visor-like ferruled docking cantilever 101 with a lower semicircular cutout 102 and a stretchable C-shaped clip 106, wherein, said docking cantilever 101 has a pair of grasping nicks 103 formed at its butt corners abutting with the semicircular cutout 102, a center conducting pin 104 disposed coaxially in protruding manner therein for mechanically contacting a contacting conductor 202 on a printed circuit board, PCB 20 with electrical connection, and an arched groove 105 configured in the internal front end thereof; and said stretchable C-shaped clip 106, which is to be lodged in the arched groove 105, has a pair of bent latching toes at both ends thereof for running through a pair of corresponding bores 201 on the PCB 20.

For connecting combination of the electrical connector 1 with the PCB 20, please refer to the FIG. 2. Firstly align the pair of grasping nicks 103 with targeted edge of the PCB 20 to push the electrical connector 1 forwards so that the pair of grasping nicks 103 are fitly engaged with targeted edge of the PCB 20; Secondly, slightly rock the stretchable C-shaped clip 106 in adjusting manner to let the pair of bent latching toes thereof to run through and hold firmly in a pair of corresponding bores 201 on the PCB 20 so that the center conducting pin 104 of the electrical connector 1 establishes a good mechanical contact with the contacting conductor 202 on the PCB 20 for having electrical connection successfully built.

However, although said stretchable C-shaped clip 106 is lodged in the arched groove 105 of the docking cantilever 101, it will incidentally slip to the left side or right side along the arched groove 105 as shown in the FIG. 3 such that the pair of bent latching toes at both ends of the stretchable C-shaped clip 106 become unsymmetrical projection manner in running through the corresponding pair bores 201 on the PCB 20; thereby, the electrical connector 1 and PCB 20 can result in unstable and shake contact issue due to lack of firm connection in between. Having realized and addressed the issues aforesaid, the inventor has constantly studied and improved the electrical connector for many years. Eventually the final improved electrical connector of the present invention is successfully developed.

SUMMARY OF THE INVENTION

Accordingly, the object of the present invention is to provide a new electrical connector 1 for being continuously firm and secure contact with PCB 2 without unstable and shake condition therebetween.

For accomplishing the above object, the inventor of the present invention contrived an innovative electrical connector, which is a connector assembly having a visor-like ferruled docking cantilever with a lower semicircular cutout and a detachable flexible C-shaped clip, wherein, said docking cantilever has a pair of grasping nicks formed at its butt corners abutting with the semicircular cutout, a center conducting pin disposed coaxially in protruding manner therein, and an arched groove configured in front end thereof; and said flexible C-shaped clip, which is to be lodged in the arched groove, has a pair of jutted noses juxtaposed on symmetrical clipping shanks thereof and a pair of bent latching toes juxtaposed at both ends thereof such that said pair of jutted noses are latched and gripped by the corresponding pair of dents at the docking cantilever in stable match manner.

Moreover, the electrical connector aforesaid, wherein, said arched groove is an outer arched groove configured in the outer front end of the docking cantilever for being lodged by the flexible C-shaped clip and said pair of jutted noses are inwardly jutted noses for being latched and gripped by the corresponding pair of dents.

Furthermore, the electrical connector aforesaid, wherein, said arched groove is an inner arched groove configured in the inner front end of the docking cantilever for being lodged by the flexible C-shaped clip and said pair of jutted noses are outwardly jutted noses for being latched and gripped by the corresponding pair of dents.

DETAILED DESCRIPTION OF THE PREFERRED EMBODIMENT

Figure 1:
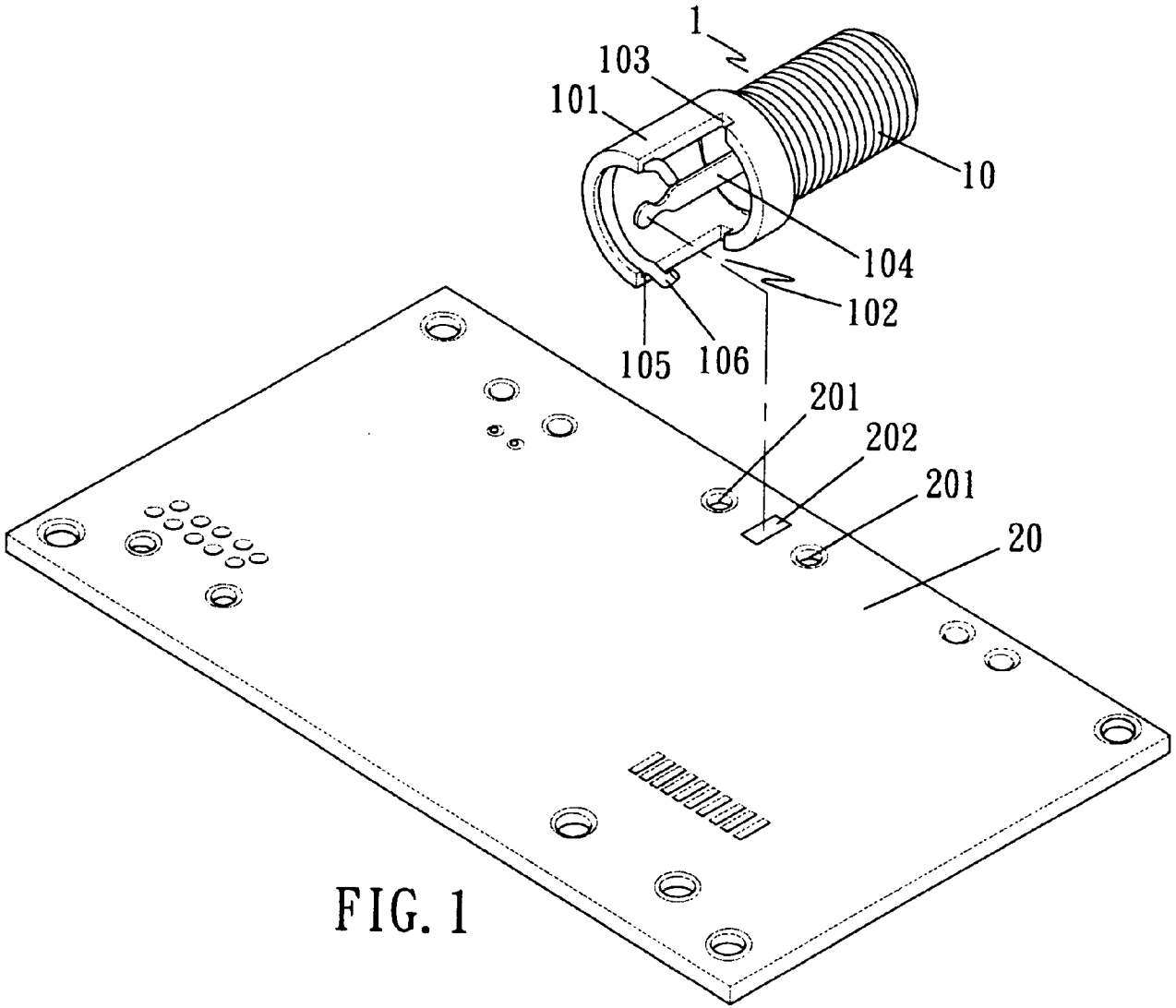
FIG. 1 is the schematic view showing the conventional electrical connector and printed circuit board (PCB) in separated manner.
Figure 2:
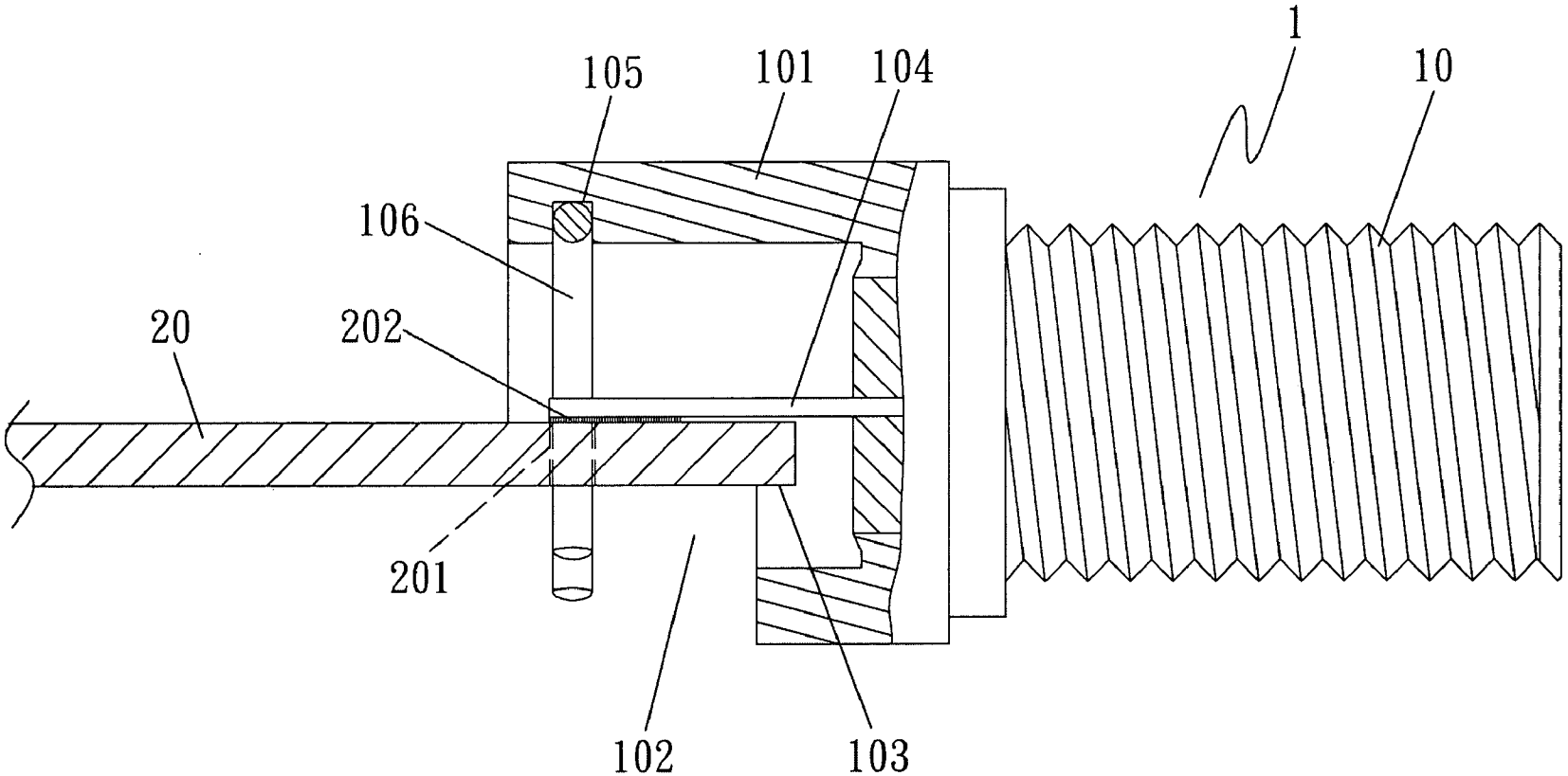
FIG. 2 is the longitudinal section view showing the conventional electrical connector and printed circuit board (PCB) in combined manner.
Figure 3:
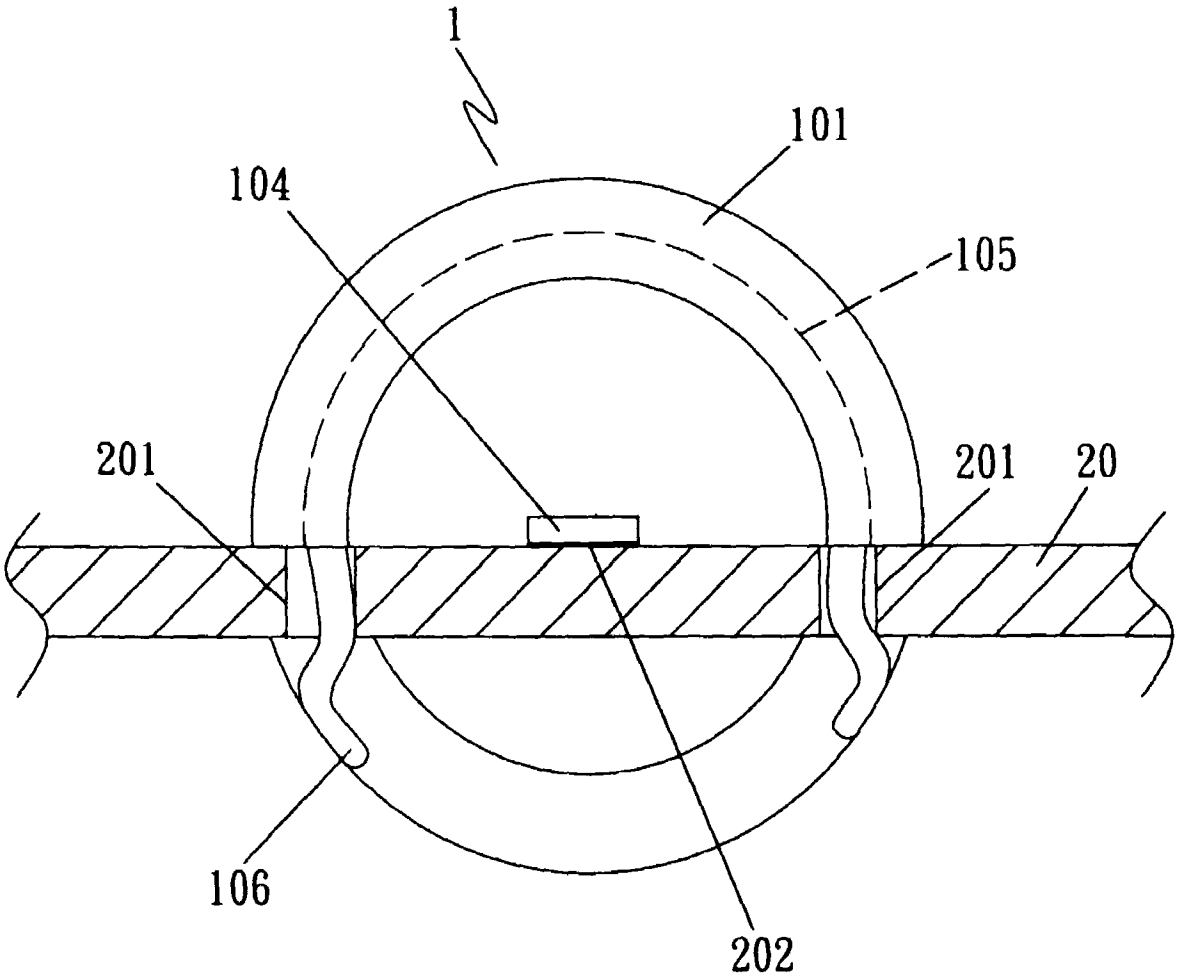
FIG. 3 is the transversal section view showing the conventional electrical connector and printed circuit board (PCB) having shake condition due to loosely latched in combined manner.
Figure 4:
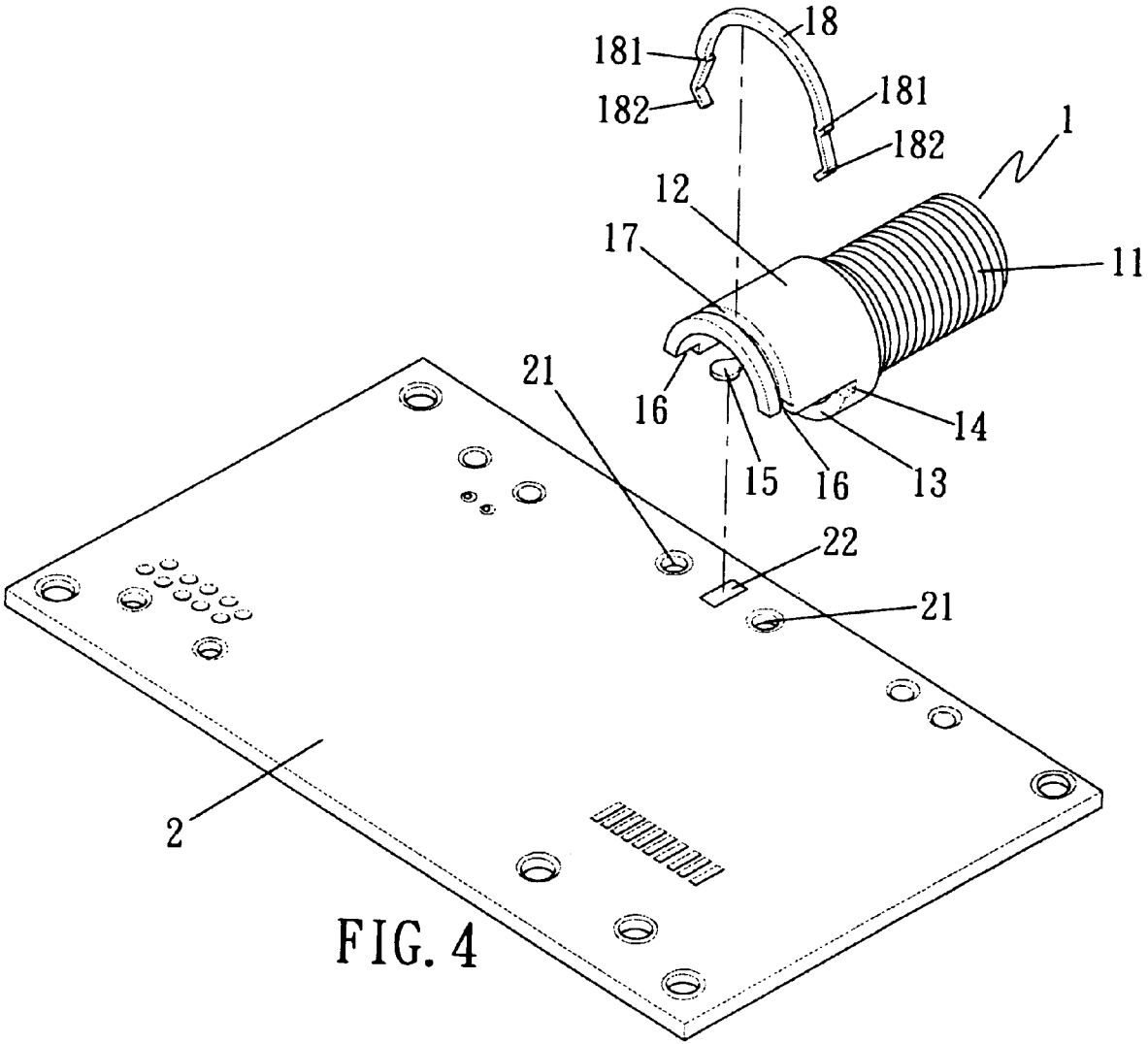
FIG. 4 is the exploded view showing the electrical connector of present invention and printed circuit board (PCB) in separated manner for the first exemplary embodiment of the present invention.

Regarding the technological means of the present invention, two exemplary preferred embodiments are described below in detail with associated drawings for your better understanding and recognizing with the present invention. For first exemplary embodiment, please refer to FIG. 4. Normally, the electrical connector 1 of the present invention is used with PCB 2 in association manner, wherein, Said electrical connector 1 is a connector assembly 11 having a visor-like ferruled docking cantilever 12 with a lower semicircular cutout 13 and a detachable flexible C-shaped clip 18, wherein, said docking cantilever 12 has a pair of grasping nicks 14 formed at its butt corners abutting with the semicircular cutout 13, a center conducting pin 15 disposed coaxially in protruding manner therein for mechanically contacting a contacting conductor 22 on a printed circuit board, PCB 2 with electrical connection, and an outer arched groove 17 configured in the outer front end thereof; and said flexible C-shaped clip 18, which is to be lodged in the outer arched groove 17, has a pair of inwardly jutted noses 181 juxtaposed on symmetrical clipping shanks thereof, and a pair of bent latching toes 182 juxtaposed at both ends thereof for running through a pair of corresponding bores 21 on the PCB 2;

Said PCB 2 has a pair of bores 21 formed near edge thereof for mating with the corresponding pair of bent latching toes 182 of the electrical connector 1 and a contacting conductor 22 formed in between the pair of bores 21 for mating with the corresponding center conducting pin 15 of the electrical connector 1 respectively.

Figure 5:
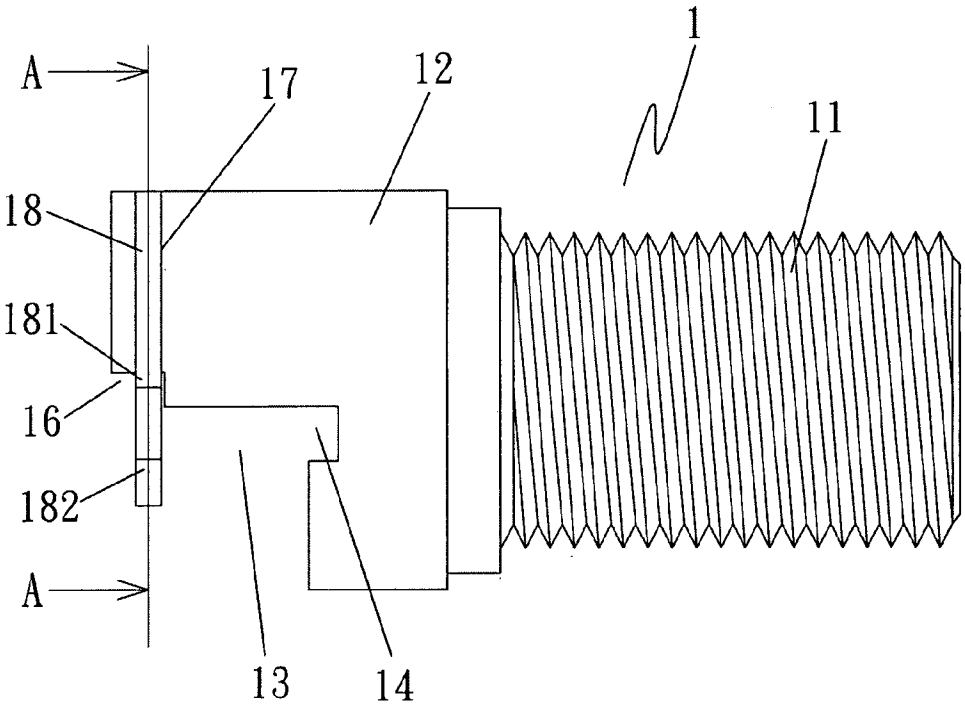
FIG. 5 is the longitudinal section view showing the electrical connector for the first exemplary embodiment of the present invention.
Figure 6:
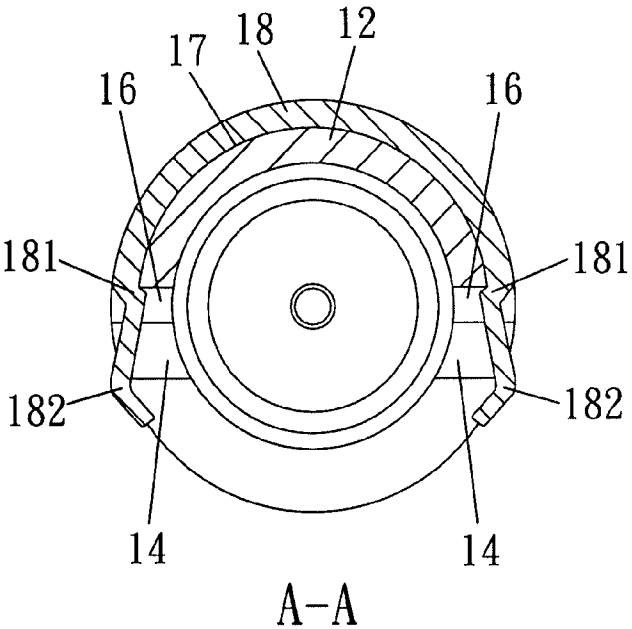
FIG. 6 is the transversal section view of the FIG. 5 taken along the transactional line of A-A.

Regarding the combined manner for the electrical connector 1 of the present invention in connection with the associated PCB 2 in first exemplary embodiment, please refer to FIGS. 5 and 6. As shown, the flexible C-shaped clip 18 is lodged in the outer arched groove 17 of the docking cantilever 12 such that the pair of inwardly jutted noses 181 on clipping shanks tightly latch and grip the corresponding dents 16 of the docking cantilever 12 in match manner. Thus, by means of the tightly latching and gripping the inwardly jutted noses 181 with the corresponding dents 16 in match manner without unsymmetrical clearance thereof or nonequivalent projection of the pair of bent latching toes 182, the possibility of slipping the flexible C-shaped clip 18 to the left side or right side along the outer arched groove 17 is eliminated so that the unstable and shake contact issue between the electrical connector 1 and PCB 2 due to lack of firm connection therebetween will never happen.

Figure 7:
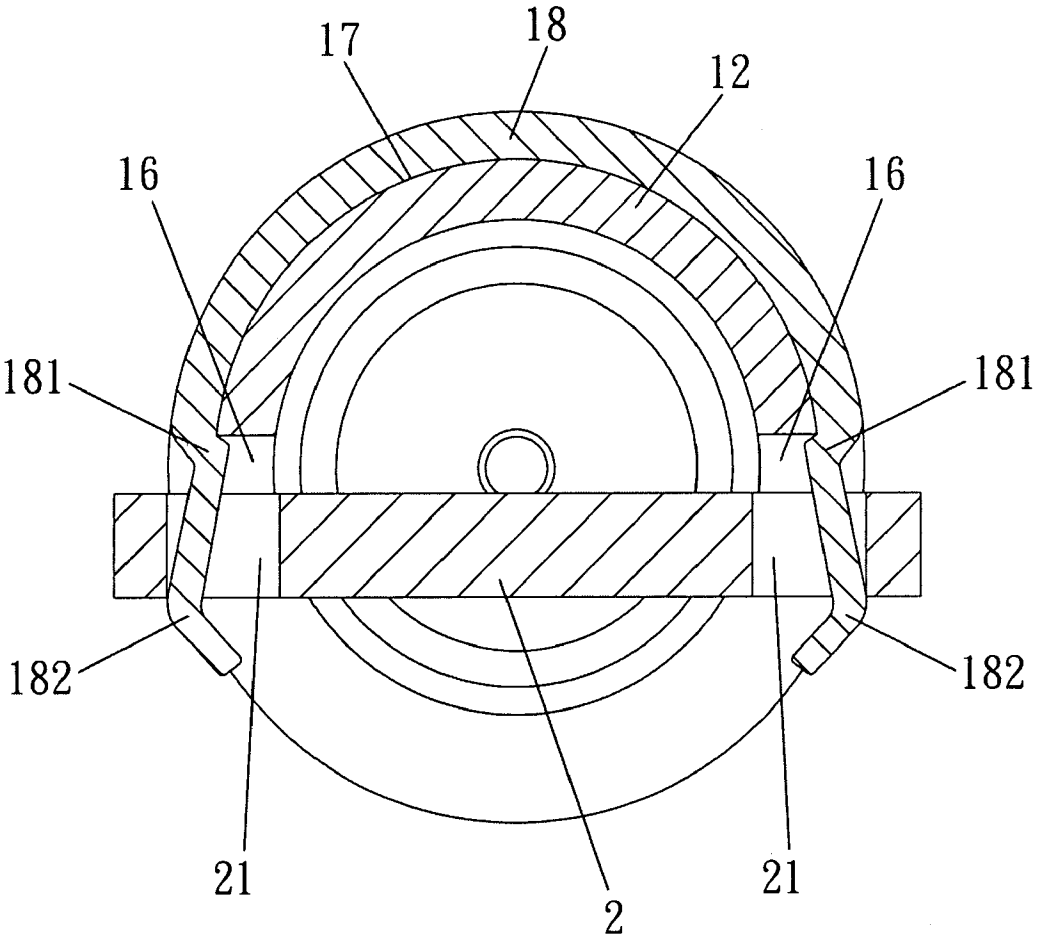
FIG. 7 is the transversal section view showing the complete assembly of electrical connector of present invention and printed circuit board (PCB) in combined manner for the first exemplary embodiment of the present invention.

For connecting combination of the connector assembly 1 with the PCB 2 in the first exemplary embodiment, please refer to the FIG. 7. Firstly align the pair of grasping nicks 14 with targeted edge of the PCB 2 to push the connector assembly 1 forwards so that the pair of grasping nicks 14 are fitly engaged with targeted edge of the PCB 2; Secondly, slightly rock the flexible C-shaped clip 18 in adjusting manner to let the pair of bent latching toes 182 thereof to run through and hold firmly in a pair of corresponding bores 21 on the PCB 2 so that the center conducting pin 15 of the connector assembly 11 establishes a good mechanical contact with the contacting conductor 22 on the PCB 2 for having electrical connection successfully built.

Figure 8:
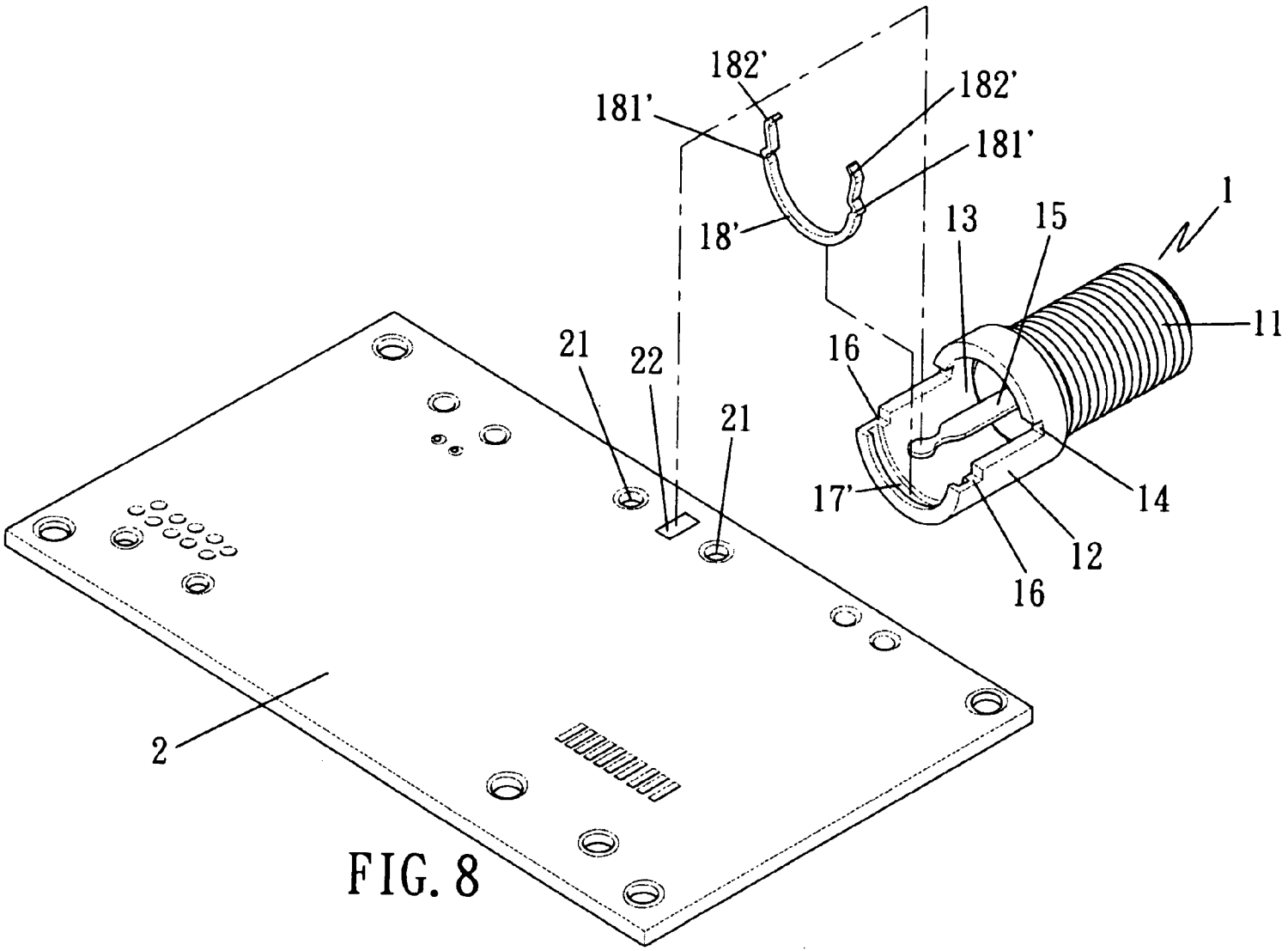
FIG. 8 is the exploded view showing the electrical connector of present invention and printed circuit board (PCB) in separated manner for the second exemplary embodiment of the present invention.

For second exemplary embodiment, please refer to FIG. 8. Similarly, the electrical connector 1 is used with PCB 2 in association manner, wherein, Said electrical connector 1 is a connector assembly 11 having a visor-like ferruled docking cantilever 12 with a lower semicircular cutout 13 and a detachable flexible C-shaped clip 18', wherein, said docking cantilever 12 has a pair of grasping nicks 14 formed at its butt corners abutting with the semicircular cutout 13, a center conducting pin 15 disposed coaxially in protruding manner therein for mechanically contacting a contacting conductor 22 on a printed circuit board, PCB 2 with electrical connection, and an inner arched groove 17' configured in the inner front end thereof; and said flexible C-shaped clip 18', which is to be lodged in the inner arched groove 17', has a pair of outwardly jutted noses 181' juxtaposed on symmetrical clipping shanks thereof, and a pair of bent latching toes 182' juxtaposed at both ends thereof for running through a pair of corresponding bores 21 on the PCB 2;

Said PCB 2 has a pair of bores 21 formed near edge thereof for mating with the corresponding pair of bent latching toes 182' of the electrical connector 1 and a contacting conductor 22 formed in between the pair of bores 21 for mating with the corresponding center conducting pin 15 of the electrical connector 1 respectively.

Figure 9:
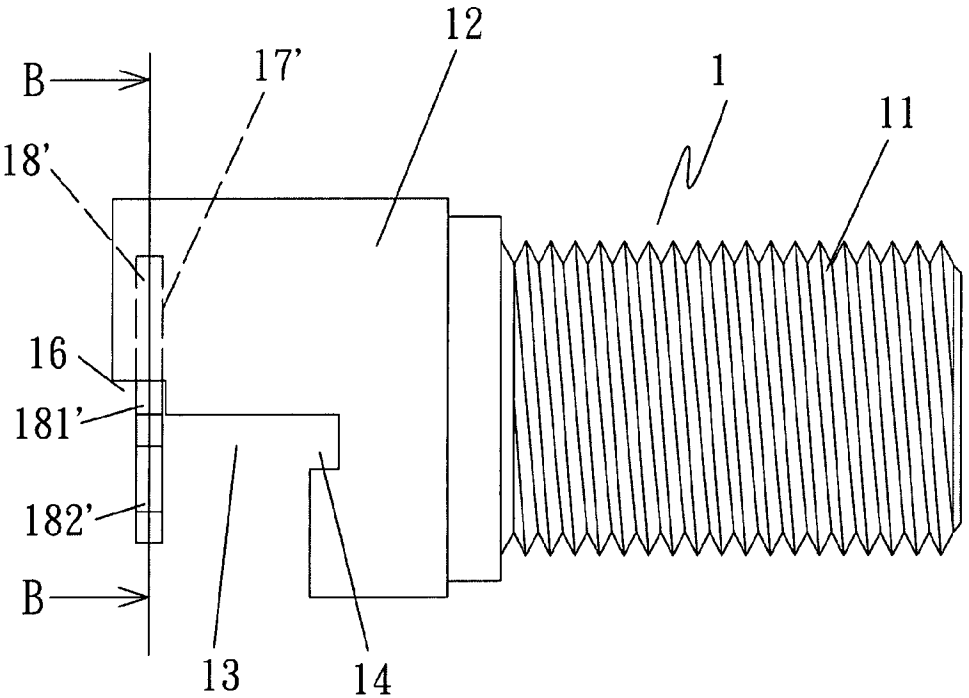
FIG. 9 is the longitudinal section view showing the electrical connector for the second exemplary embodiment of the present invention.
Figure 10:
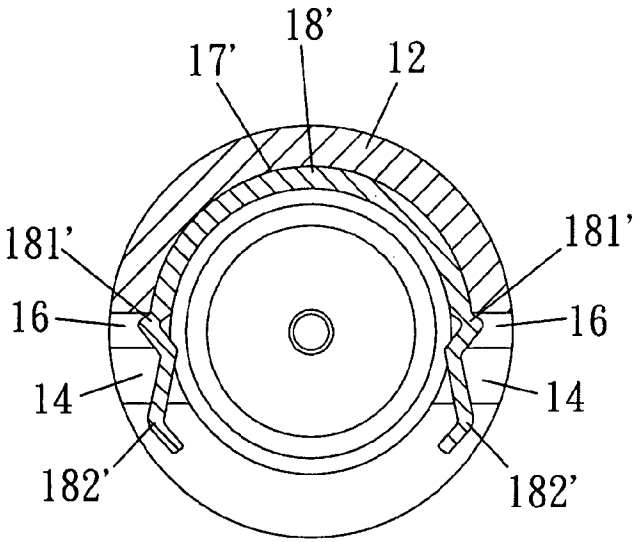
FIG. 10 is the transversal section view of the FIG. 9 taken along the transactional line of B-B.

Regarding the combined manner for the electrical connector 1 of the present invention in connection with the associated PCB 2 in second exemplary embodiment, please refer to FIGS. 9 and 10. As shown, the flexible C-shaped clip 18' is lodged in the inner arched groove 17' of the docking cantilever 12 such that the pair of outwardly jutted noses 181' on clipping shanks tightly latch and grip the corresponding dents 16 of the docking cantilever 12 in match manner. Thus, by means of the tightly latching and gripping the outwardly jutted noses 181' with the corresponding dents 16 in match manner without unsymmetrical clearance thereof or nonequivalent projection of the pair of bent latching toes 182', the possibility of slipping the flexible C-shaped clip 18' to the left side or right side along the inner arched groove 17' is eliminated so that the unstable and shake contact issue between the electrical connector 1 and PCB 2 due to lack of firm connection therebetween will never happen.

Figure 11:
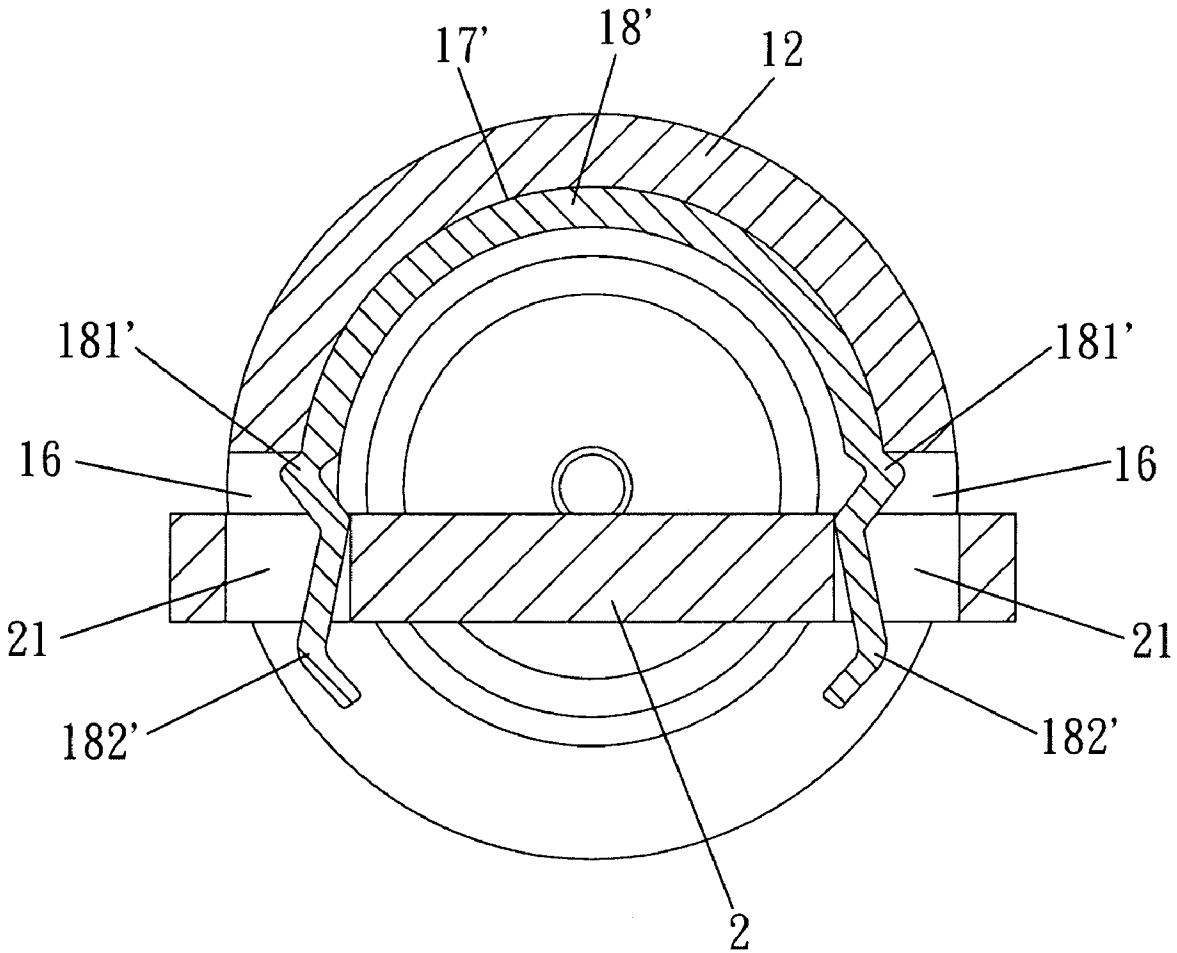
FIG. 11 is the transversal section view showing the complete assembly of electrical connector of present invention and printed circuit board (PCB) in combined manner for the second exemplary embodiment of the present invention.

For connecting combination of the connector assembly 1 with the PCB 2 in the second exemplary embodiment, please refer to the FIG. 11. Similarly, firstly align the pair of grasping nicks 14 with targeted edge of the PCB 2 to push the connector assembly 1 forwards so that the pair of grasping nicks 14 are fitly engaged with targeted edge of the PCB 2; Secondly, slightly rock the flexible C-shaped clip 18' in adjusting manner to let the pair of bent latching toes 182' thereof to run through and hold firmly in a pair of corresponding bores 21 on the PCB 2 so that the center conducting pin 15 of the connector assembly 11 establishes a good mechanical contact with the contacting conductor 22 on the PCB 2 for having electrical connection successfully built.

From the above disclosure, the key innovative contrivances for the electrical connector 1 of the present invention are the pair of dents 16, outer/inner arched groove 17, 17' and inwardly/outwardly jutted nose 181, 181' on clipping shanks.

By means of the tightly latching and gripping the inwardly/outwardly jutted nose 181, 181' with the corresponding dents 16 in match manner without unsymmetrical clearance thereof or nonequivalent projection of the pair of bent latching toes 182, 182', the possibility of slipping the flexible C-shaped clip 18, 18' to the left side or right side along the outer/inner arched groove 17, 17' is eliminated so that the effect in continuously stable and secure contact between the electrical connector 1 and PCB 2 can be successfully achieved without worry about the unstable and shake contact issue therefrom.

In conclusion, the technological means disclosed heretofore for the present invention prove that it has innovative novelty of improvement beyond the obviousness of the prior arts and practical industrial usage for achieving the expected objects, which meet the basic criterion of the patentability. Accordingly, we submit the patent application with specifications for your perusal and examination with expectation for being granted a patent approval, which will be greatly appreciated by us. However, all the disclosure heretofore is only the exemplary preferred embodiments, which are not intended for limiting the embodiment scope of the present invention. Therefore, any equivalent alteration or modification, which does not depart from the essence and nature of the specifications for the present invention, should be reckoned as in the range for the claims of the present invention.

What is claimed is:

1. An electrical connector is a connector assembly having a visor-like ferruled docking cantilever with a lower semicircular cutout and a detachable flexible C-shaped clip, wherein, said docking cantilever has a pair of grasping nicks formed at its butt corners abutting with the semicircular cutout, a center conducting pin disposed coaxially in protruding manner therein, and an arched groove configured in front end thereof; and said flexible C-shaped clip, which is to be lodged in the arched groove, has a pair of jutted noses juxtaposed on symmetrical clipping shanks thereof and a pair of bent latching toes juxtaposed at both ends thereof such that said pair of jutted noses are latched and gripped by the corresponding pair of dents at the docking cantilever in stable match manner.

2. The electrical connector as recited in claim 1, wherein, said arched groove is an outer arched groove configured in the outer front end of the docking cantilever for being lodged by the flexible C-shaped clip and said pair of jutted noses are inwardly jutted noses for being latched and gripped by the corresponding pair of dents.

3. The electrical connector as recited in claim 1, wherein, said arched groove is an inner arched groove configured in the inner front end of the docking cantilever for being lodged by the flexible C-shaped clip and said pair of jutted noses are outwardly jutted noses for being latched and gripped by the corresponding pair of dents.

* * * * *